US005768818A

United States Patent [19]

Rustick

[11] Patent Number: 5,768,818

[45] Date of Patent: Jun. 23, 1998

[54] ATTACHMENT FOR AFFIXATION TO THE BARREL OF A GAS OPERATED WEAPON

[76] Inventor: Joseph M. Rustick, 3043 E. Cypress, Phoenix, Ariz. 85008

[21] Appl. No.: 797,040

[22] Filed: Feb. 10, 1997

[51] Int. Cl.[6] ..... F41A 21/00

[52] U.S. Cl. ..... 42/75.02; 89/193

[58] Field of Search ..... 42/75.01, 75.02, 42/17; 89/193, 191.01, 192

[56] References Cited

U.S. PATENT DOCUMENTS

| | | | |
|---|---|---|---|
| 422,846 | 3/1890 | Sneider | 42/75.01 |
| 3,166,983 | 1/1965 | Lizza | 89/191 |
| 3,538,810 | 11/1970 | Maillard | 89/159 |
| 3,592,101 | 7/1971 | Vartanian | 89/193 |
| 3,601,002 | 8/1971 | Janson | 89/191 |
| 3,857,323 | 12/1974 | Ruher et al. | 89/191 R |
| 4,125,054 | 11/1978 | Jennie | 89/193 |
| 5,351,598 | 10/1994 | Schuetz | 89/185 |
| 5,475,940 | 12/1995 | Mauch et al. | 42/75.02 |

*Primary Examiner*—Charles T. Jordan
*Assistant Examiner*—Meena Chelliah
*Attorney, Agent, or Firm*—Jospeh H. Roediger

[57] ABSTRACT

A gas chamber fixture having attachment to the barrel of a gas-operated weapon wherein the barrel and the weapon are mechanically attached by means of a mating mortise and tenon. A bead is received in recesses formed in the adjacent surfaces of the mortise and tenon to facilitate rotation during attachment and provide sealing engagement of the joined parts. A gas passage between barrel and chamber is provided through the bead to provide the driving force to the drive mechanism located in the chamber.

15 Claims, 2 Drawing Sheets

ATTACHMENT FOR AFFIXATION TO THE BARREL OF A GAS OPERATED WEAPON

BACKGROUND OF THE INVENTION

This invention relates to an attachment for affixation to the barrel of a gas-operated weapon and, more particularly, to a gas chamber housing which is affixed by mechanical attachment to the barrel.

In conventional gas-operated weapons, the gas pressure from the discharge of a cartridge is supplied to a gas chamber affixed to the barrel of the weapon. The chamber receives gas under pressure by means of a gas passage extending into the interior of the barrel. The gases produced from the cartridge in the barrel are supplied to the chamber and utilized to impart motion to a piston connected to an actuating mechanism. The mechanism automatically ejects spent cartridges and effects a reloading the weapon with the next round.

At present, the attachment of the gas chamber housing is effected by using welding or brazing techniques. The use of these manufacturing processes requires that the barrel be heated to high temperatures thereby providing an opportunity for the high degree of linearity and uniformity of the barrel as initially machined to depart from the original design specifications. These departures from the specifications frequently manifest themselves as unpredictable variations in the performance of the weapon. The presence of departures from the expected operating performance of a high performance weapon may well render the weapon unsuitable for use for its intended purpose.

Accordingly, a primary objective of the present invention is the provision of a gas chamber housing for mechanical attachment to the barrel of a semi-automatic weapon. Further, the invention is directed to a gas chamber housing that is affixed to and may be removed from the barrel of a weapon for repair or replacement without the use of welding or brazing techniques. A further objective is the provision of a housing for mechanical attachment to a weapon which includes a gas passage between the adjacent parts and maintains engagement sealing therebetween.

SUMMARY OF THE INVENTION

The housing attachment of the subject invention is to be affixed to the barrel of a gas operated weapon by mechanical means. The housing includes a gas chamber having a port to receive a drive piston therein. The piston is connected to a drive mechanism for the gas operated weapon. The piston is responsive to changes in gas pressure in the chamber and the linear piston movement is translated by the drive mechanism. The chamber communicates with the interior of the barrel via a gas passage which extends through the housing, the adjacent portion of the barrel and a sealing bead interposed therebetween.

The underside of the barrel is provided with a transverse slot. The slot has tapered side edges for joining with a mating raised section formed on the housing. In cross-section, the slot and raised portion form a mortise and tenon joint. In addition, a recess is formed between the top surface of the raised section and a sealing bead is located in the recess. When the attachment is secured to the barrel, the sealing bead is in contact with the barrel and the raised section. The gas passage is then formed in the bead and extends into the barrel and the gas chamber.

The raised section of the housing has opposing curved ends with inwardly tapered sides to form the tenon for the joint with the barrel. During assembly, the housing is rotated and the curved tenon rotates into firm engagement with the transverse slot. Rotation is permitted by the curved ends of the raised section and facilitated by the use of a spherical sealing bead in the recess. The recess is positioned in the center of the raised section as defined by the center of a circle including the curved ends as part of the circumference. Preferably, a mating recess is formed in the opposing portion of the barrel with the sealing bead positioned therebetween to provide a movable pivot point during assembly.

In the steps of affixation, the housing with sealing bead is initially orthogonally oriented in the transverse slot. Mechanical force is then applied by a wrench to rotate the housing into alignment with the longitudinal axis of the barrel. A gas passage is then drilled from the opposing side of the housing through the chamber in the housing, the sealing bead and into the barrel interior. The portion of the passage between the chamber and the underside of the housing is then back-filled. The piston and linkage to the actuating mechanism are then positioned at the first port of the housing. An internal stop is located in the gas chamber to limit the travel of the piston and prevent blocking of the gas passage. Since the bead is in sealing engagement with both the barrel and housing, the gas passage between chamber and barrel interior is well-defined and does not leak when the increase in gas pressure generated in the barrel is transmitted to the gas chamber.

The transmission of the rapid increase in gas pressure from barrel to chamber can be regulated by the provision of a regulating port in the side of the housing. The port extends inwardly to the gas passage and movably receives a regulating pin therein. The adjustment of the pin varies the area of the gas passage and is used to control the impulse provided to a piston in the chamber by the rapid increase in gas pressure within the barrel.

The housing also can include ports at each end. In the preferred embodiment, the gas chamber extends between opposing ports located at the ends of the housing. The first port receives the piston and the second port is provided with a threaded sealing plug. A regulating pin affixed to the end of the sealing plug serves as an internal stop to determine the effective length of the chamber for piston travel. The pin prevents a piston from at any time blocking the transmission of gas into the chamber by limiting travel in the return direction.

The present invention provides a housing for receiving the increased pressures from a weapon barrel and imparting the force thereof to a piston coupled to a conventional drive mechanism for a gas operated weapon. The housing is attached securely to the weapon barrel without requiring the use of brazing or welding techniques thereby preserving the performance characteristics of the weapon during manufacture. Further features and advantages of the invention will become more readily apparent from the following detailed description of a preferred embodiment when viewed in conjunction with the accompanying drawings.

DESCRIPTION OF THE PREFERRED EMBODIMENT

Figure 1:
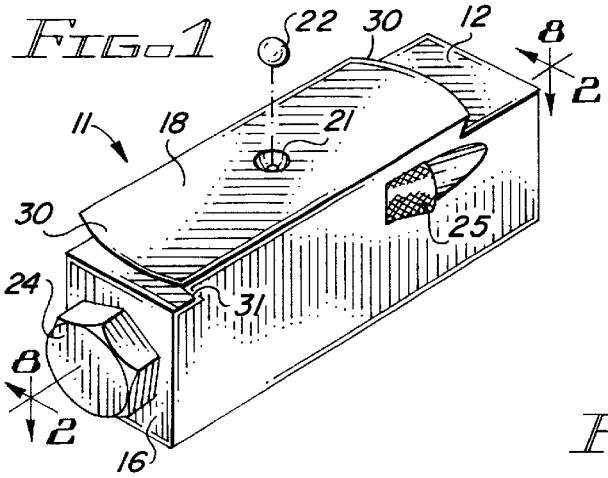
FIG. 1 is a view in perspective of a preferred embodiment of the invention.

Referring now to FIG. 1, the gas chamber attachment for affixation to the barrel of a gas operated weapon is shown including housing 11 formed in a generally parallelepiped shape. The housing has opposing surfaces shown as top surface 12 and bottom surface 14, and opposing ends 16 and 17. The longitudinal axis of the housing extends between ends 16 and 17 for general alignment with the axis of the barrel. The housing is hollow defining a gas chamber therein for receiving increases in gas pressure transmitted from the barrel.

Figure 2:
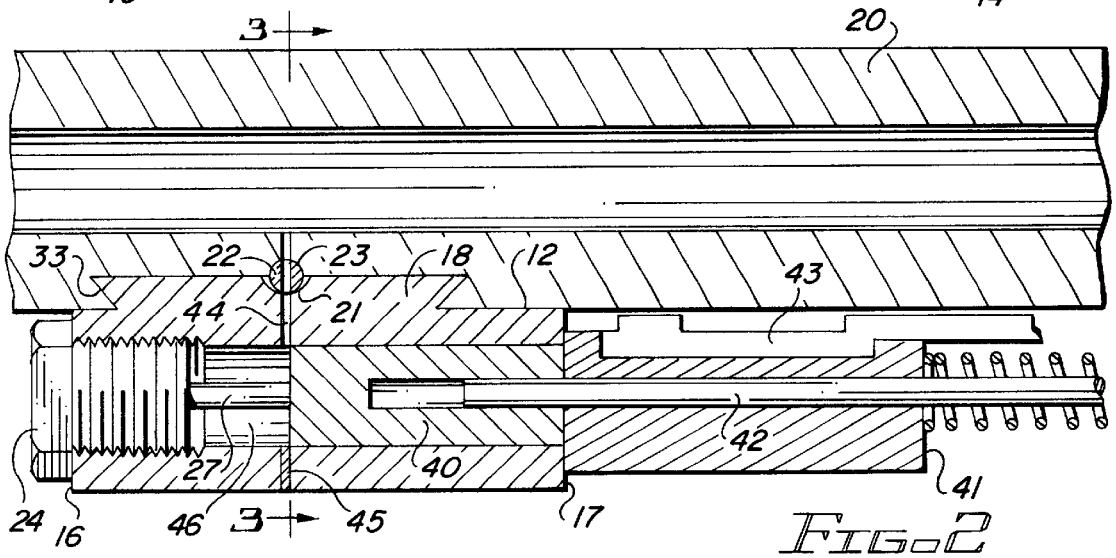
FIG. 2 is a view in partial cross-section taken along line 2—2 of FIG. 1 showing the embodiment of FIG. 1 attached to a weapon barrel.
Figure 4:
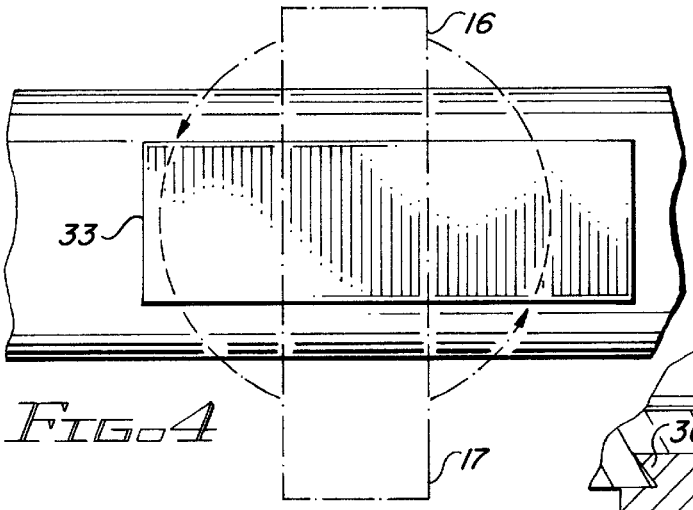
FIG. 4 is a view of the underside of a weapon barrel showing the rotational movement of the embodiment during assembly.

The top surface 12 includes a raised section 18 extending along the major portion of the top surface and terminating in opposing curved ends 30. Each curved end has an inwardly tapered side 31 for mating engagement with a tapered slot transversely disposed in the underside of a weapon barrel. The attachment of the housing to the barrel 20 is shown in FIG. 2 wherein transverse slot 33 has received the raised portion 18 of the housing. FIG. 2 shows the placement of piston 40 in the gas chamber. As shown in the return position, the piston extends to the port of the housing and when actuated rapidly travels to impart motion to inertia member 41 along axial guide 42. This motion is transmitted to the slide bar member 43 coupled on either side of the inertia piece in a typical drive mechanism for enabling the automatic operation of the weapon. The particular configuration of the piston and the linkage to external coupling means used to transmit the force to the utilization means is not part of the invention and further description is not made.

In the attached position as seen in FIG. 2, the housing is provided with ports at the opposing ends 16 and 17. As shown, port 17 receives the piston 40 for axial movement therein and the other port is partially threaded to receive sealing member 24. The sealing member is provided with an axially-aligned spacer 27 affixed at its inner end. The spacer defines the inner limit for travel of the piston 40 and insures that in the return position the piston 40 does not reside across the end of passage 44 and block the transmission of gas from the interior of the barrel into the chamber 46. The adjustment of the location of the internal stop provided by spacer 27 is accomplished by changing the insertion depth of threaded sealing member 24.

Figure 3:
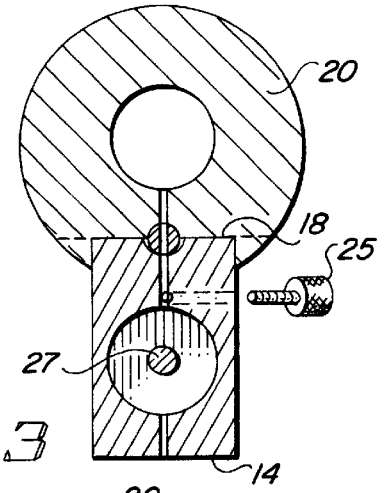
FIG. 3 is a view in cross-section taken along line 3—3 of FIG. 2.
Figure 8:
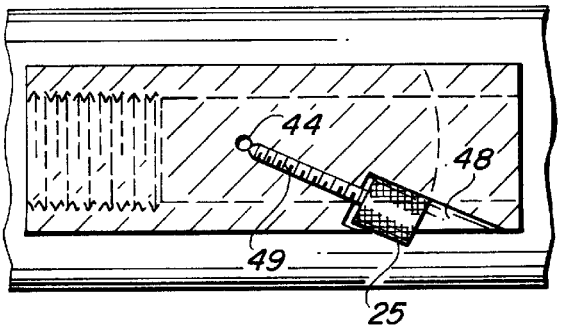
FIG. 8 is a view in cross-section taken along line 8—8 of FIG. 1 showing the regulating pin.

The gas passage 44 extends from the interior of barrel 20 through the steel sealing bead 22 and into the gas chamber 46. It is to be noted that the downward extension of gas passage 44 is back-filled with sealing plug 45 so that the gas chamber is provided with a single passage 44 for the flow of gas. The downward extension of the gas passage in the housing results from the formation of the gas passage after assembly by drilling from the bottom surface of the housing. Consequently, the lower portion of the hole formed therein is plugged to prevent gas leakage and loss of pressure in the chamber. The cross-sectional area of the gas passage 44 can be varied in the embodiment as shown in FIG. 3 by the adjustment of threaded regulating pin 25. The pin 25 is received in a threaded hole which extends inwardly to intersect the gas passage 44. The threaded hole in the housing is angularly disposed from the external surface of the housing as shown in FIGS. 1 and 8 to permit adjustment by the application of finger pressure to the side of the knurled end of regulating pin 25. The reduction of the cross-sectional area of the gas passage by the regulating pin results in a reduction in the rate of pressure increase in chamber 46 and produces a corresponding decrease in the impulse applied to piston 40.

The steps taken in the attachment of the gas chamber housing to the underside of barrel 20 are shown in FIGS. 4 through 7. Initially, the barrel is machined to include transverse slot 33 and the recess 23 centrally located therein. The weapon is typically inverted and the spherical bead 22 is placed in recess 23. The bead is dimensioned to have diameter no less than the sum of the depths of the recesses 21 and 23. The housing is placed thereon as shown by the dashed line outline in FIG. 4 with the recess 21 overlying the bead. Next, the housing is rotated in the direction of the arrows by using a wrench to the aligned position of FIG. 5. After rotation, the curved ends 30 engage the adjacent edges of the slot 33 formed in the barrel and the bead 22 resides firmly between the barrel and the raised section 18 of the housing. The bead aids in the rotation of the housing into the aligned position and serves to align the ports by self-adjustment in the recesses. In practice, the characteristics of the materials determine if the bead should be made oversize to insure a sealing fit between barrel and housing. The bead permits relative movement of the parts during assembly. In addition, the rotation is aided by the bead to enable proper seating of the tenon in the mortise of the barrel. The curved ends 30 of raised portion 18 are arcuate sections of a circle having a center located at recess 21. As the housing rotates, the curved ends tangentially approach the inwardly tapered side walls of slot 33 to the aligned position.

Figure 5:
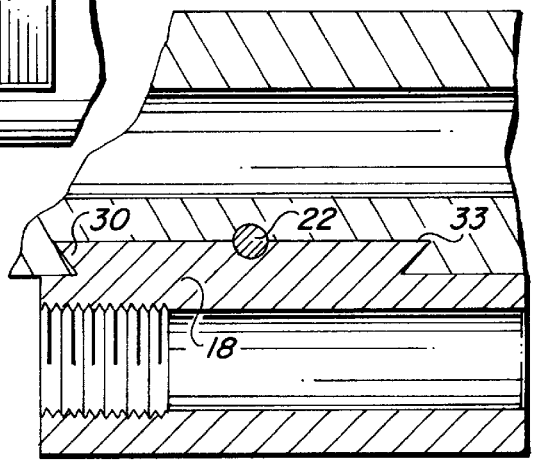
FIG. 5 is a partial view in cross-section showing the attached housing during assembly.
Figure 6:
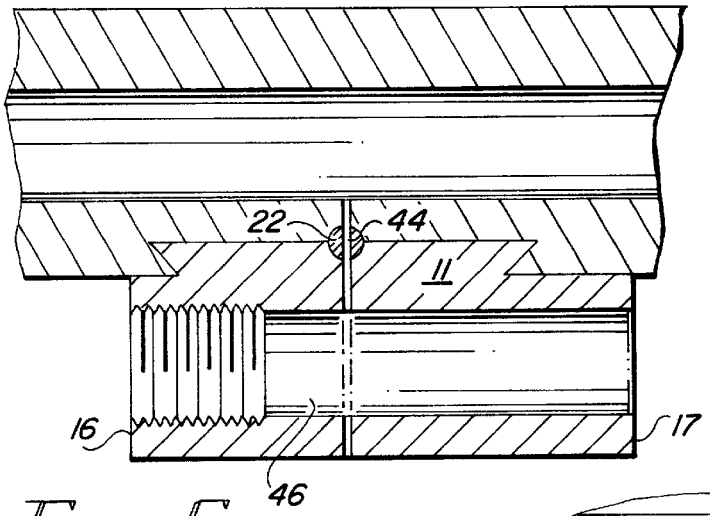
FIG. 6 is a view in cross-section of the attached housing of FIG. 5 showing the formation of the gas passage.
Figure 7:
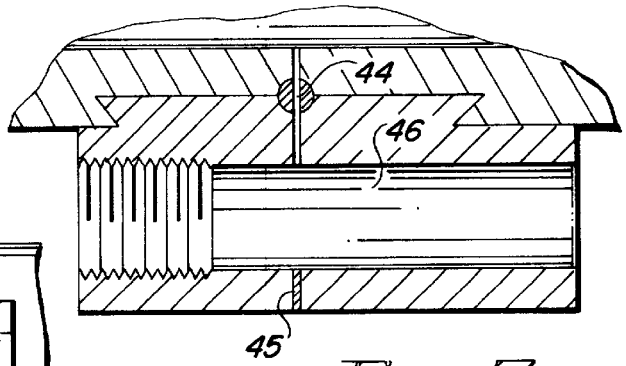
FIG. 7 is a view in cross-section showing the back-filling of the gas passage of FIG. 6.

Following the alignment to the position shown in FIG. 5, the gas passage 44 is drilled for a typical diameter of 50 mils from the bottom of the housing 11 to extend through the bead 22 into the barrel. The resultant passage is shown in FIG. 6. Next, a sealing plug 45 is inserted in that portion of the passage located in the bottom surface of the housing as noted in FIG. 7. The angled recess 48 machined in the housing extends through threaded channel 49 to the gas passage 44. The regulating pin 25 is threaded into channel 49. The sealing member 24 with spacer 27 extending into the gas chamber 46 is threaded into the first end 16 of the housing. The piston 40 is then seated into the chamber through second end 17 and coupled to the particular drive mechanism being used. The adjustment of spacer 27 and piston 40 is then made to ensure that the piston does not block the inner terminus of the gas passage during operation. It is to be noted that the parts are required to be machined to close tolerances to insure a secure fit between the housing and the barrel as well as between the recesses and the bead. The location of the recess in the raised section determines the location on the bottom surface of the housing for the drilling of the gas passage. In the embodiment shown, the material used for the housing is a chrome-moly-steel alloy.

While the above description has referred to a preferred embodiment of the invention, it is to be noted that variations and modifications may be made therein without departing from the scope of the invention as claimed.

I claim:

1. An attachment containing a gas chamber for affixation to the barrel of a gas operated weapon, said attachment having an open end for receiving the piston of a drive mechanism for ejecting spent shells from the weapon, said barrel containing a transverse slot for receiving the attachment, said attachment comprising:

a) a housing having first and second opposing surfaces and first and second opposing ends, b) a chamber formed in said housing and having a port in the second end of said housing for receiving a piston therein;

c) a raised section formed on the first surface of the housing, said raised section having a top surface and inwardly tapered sides, said raised section being received by the transverse slot in the barrel;

d) a recess formed in the top surface of said raised section;

e) a sealing bead positioned in said recess for contacting the barrel and providing a sealing fit between said barrel and said raised section; and f) a gas passage formed in said sealing bead and extending therethrough, said passage extending to the chamber in said housing and to the interior of the barrel, the increase in gas pressure generated in the barrel by firing a bullet being transmitted through the gas passage to the gas chamber and the piston therein.

2. The attachment of claim 1 wherein the top surface of the raised section has curved ends, the inwardly tapered sides depending from the curved ends.

3. The attachment of claim 2 wherein said curved ends form arcuate sections of a circle having a center located at the midpoint of the top surface.

4. The attachment of claim 3 wherein said chamber extends between the first and second ends of said housing and further comprising a sealing member movably mounted in the first end of said housing.

5. The attachment of claim 4 further comprising a spacer adjacently positioned to the sealing member for maintaining a separation between the piston and said sealing member.

6. The attachment of claim 5 wherein said gas passage is formed in the housing between said first and second surfaces and further comprising a sealing plug inserted in said gas passage at the second surface of the housing.

7. The attachment of claim 6 wherein said housing includes a regulating port extending inwardly to the gas passage and further comprising a regulating pin movably received in the regulating port for varying the area of the gas passage.

8. In a semi-automatic weapon of the type having a gas-operated drive mechanism for ejecting spent shells therefrom wherein the gas for driving said mechanism is supplied from the barrel, a gas drive transmission system which comprises:

a) a transverse slot formed on the barrel, said slot having inwardly tapered sides;

b) a housing containing a chamber therein, said housing having a longitudinal axis and including a centrally located raised platform thereon, said platform having inwardly tapered arcuate ends for permitting rotation of the platform in the transverse slot to provide engagement with the transverse slot, said housing having a first port located on the longitudinal axis to receive the drive mechanism therein;

c) opposing recesses formed in the transverse slot and the raised platform of said housing for receiving a sealing bead therebetween;

d) a sealing bead positioned in said recesses, said bead being fixed in position upon mating engagement of the housing and barrel and providing a sealing fit therebetween, and e) a gas passage extending through the bead into the barrel and housing, an increase in pressure in said barrel being transmitted to the chamber to actuate the drive mechanism.

9. The gas drive transmission system of claim 8 wherein said housing contains a second port located on said longitudinal axis and further comprising a sealing plug located in said second port.

10. The gas drive transmission system of claim 9 wherein said sealing plug is provided with a spacing pin to maintain a spacing distance between the sealing plug and the drive mechanism.

11. The gas drive transmission system of claim 10 wherein the recess formed in the raised platform is located at the center thereof.

12. The gas drive transmission system of claim 11 further comprising regulating means formed in said housing and extending into the gas passage for controlling the size of the gas passage.

13. A method of attaching a gas chamber housing to the barrel of a weapon with a mortise and tenon joint wherein the housing is provided with a tenon which comprises the steps of:

a) forming curved opposing edges on the tenon, said edges being arcuate portions of a circle;

b) forming a recess on said housing;

c) locating a spherical bead in said recess;

d) placing the housing and bead in the mortise; and e) rotating the housing to cause the curved edges of the tenon to engage the mortise on the barrel.

14. The method in accordance with claim 13 further comprising the steps of drilling a gas passage through the gas chamber housing and spherical bead to communicate with the barrel and back-filling a portion of said passage.

15. The method in accordance with claim 14 further comprising the step of forming mating recesses in the barrel and the housing for receiving the spherical bead therebetween.

* * * * *